United States Patent [19]

Tornero et al.

[11] Patent Number: 5,050,933

[45] Date of Patent: Sep. 24, 1991

[54] STACKING CHAIR WITH COLLAPSIBLE ARMS

[76] Inventors: Marta Tornero, 6117 Ballinger Rd., Greensboro, N.C. 27410; Bruce Adams, 813 Cloniger Dr., Thomasville, N.C. 27360

[21] Appl. No.: 546,900

[22] Filed: Jul. 2, 1990

[51] Int. Cl.[5] ..... A47G 7/54

[52] U.S. Cl. ..... 297/417; 297/115; 248/118.3

[58] Field of Search ..... 297/416, 417, 115, 151; 248/188.5, 118.3

[56] References Cited

U.S. PATENT DOCUMENTS

| | | | |
|---|---|---|---|
| 388,076 | 8/1888 | Schmidt | 248/188.5 |
| 560,547 | 5/1896 | Shotwell | 297/417 |
| 2,215,758 | 9/1940 | Knight et al. | 297/115 |
| 2,552,720 | 5/1951 | Keough | 297/151 |
| 3,854,773 | 12/1974 | Thomas | 297/417 |
| 3,993,351 | 11/1976 | Rodway | 297/416 |
| 4,186,456 | 2/1980 | Huemphner | 297/417 |
| 4,489,980 | 12/1984 | Friedrich | 297/417 |
| 4,489,981 | 12/1984 | Goletski | 297/416 |

FOREIGN PATENT DOCUMENTS

| | | | |
|---|---|---|---|
| 452585 | 11/1929 | Fed. Rep. of Germany | 297/416 |

*Primary Examiner*—Laurie K. Cranmer
*Assistant Examiner*—Cassandra L. Hope

[57] ABSTRACT

A lightweight chair capable of stacking for storage purposes is provided with collapsible, adjustable arms. The arms can be raised to a desired height where they automatically lock in place for use. The lock assembly can be manually released in order to adjust the height of the arms and coil springs prevent the arms from inadvertently collapsing against the seat frame and possibly injuring the hand of the user.

4 Claims, 2 Drawing Sheets

STACKING CHAIR WITH COLLAPSIBLE ARMS

BACKGROUND OF THE INVENTION

1. Field Of The Invention

The present invention pertains to furniture and particularly to lightweight chairs which are known in the trade as "stacking" chairs due to their ability to nestle, one within the other for compact storage purposes. The chairs of the present invention include arms which can be raised individually for use or collapsed when not needed or while stacked.

2. Description Of The Prior Art And Objectives Of The Invention

Various lightweight chairs have been utilized in the past for meetings, conventions and other gatherings where a large number of chairs are temporarily needed in a particular location and are later removed and stacked for storage. Arms or armrests are not generally provided on these chairs since the armrests will prevent compact storage, which is a convenient and highly desired feature. Many standard household and other more expensive chairs utilize armrests but such armrests are generally fixed relative to the seat and cannot be raised or lowered as needed and hence such chairs cannot be easily stacked. Accordingly, with the disadvantages, inconveniences and lack of versatility of conventional stacking and other chairs which do not include armrests, the present invention was conceived and one of its objectives is to provide a stackable chair which includes a pair of armrests which can be raised and made available as needed.

It is yet another objective of the present invention to provide a chair having an armrest which can be easily raised or lowered to a plurality of positions in a quick and efficient manner.

It is still another objective of the present invention to provide a chair having an armrest which can be rapidly and safely lowered without fear of injury to the user.

It is still another objective of the present invention to provide a chair having a pair of independently adjustable armrests whereby the height of the armrests can be quickly and easily changed including lowering completely, depending on the desired position of each armrest by the user.

Various other objectives and advantages of the present invention become apparent to those skilled in the art as a more detailed explanation of the invention is presented below.

SUMMARY OF THE INVENTION

The aforesaid and other objectives are realized by providing a chair which is conventionally termed a "stacking chair" which has been modified to include a pair of independently raisable arms. The seat and back of the chair are molded in one piece from a durable material such as polypropylene and the seat is joined to a tubular frame from which legs depend. Each of the arms consists of a substantially horizontal armrest and a vertical armrest support that is slidably, telescopically mounted within a hollow leg. A lock assembly is positioned within the frame on each side, one for each arm whereby an arm can be raised or lowered and held in place at one or more positions selected by the user. A grip which is part of the lock assembly will allow the user to release the arm from any of a variety of positions whereupon the arm can be lowered to, for example its fully collapsed posture. A coil spring located in the bottom of each leg will cushion the final distance of descent of the armrest support and will thereby prevent the user from being injured should his fingers be inadvertently placed between the frame and the descending armrest. When the arms are fully lowered the coil springs will provide an initial upward thrust as the lock assembly is released.

DESCRIPTION OF THE PREFERRED EMBODIMENT

Figure 2:
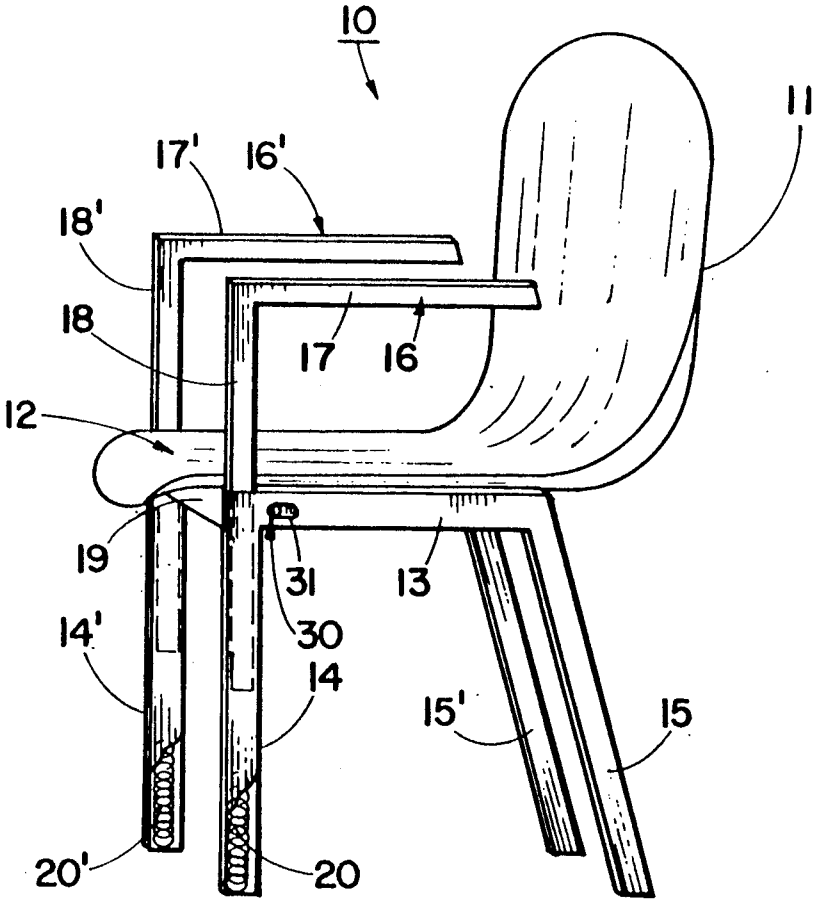
FIG. 2 demonstrates the chair as shown in FIG. 1 with the arms raised to a height as may be comfortable for the user.
Figure 4:
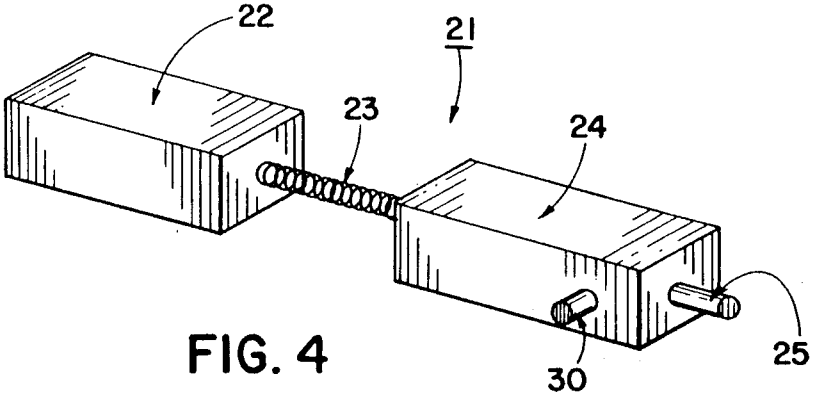
FIG. 4 depicts a perspective view of the lock assembly removed from the frame.
Figure 3:
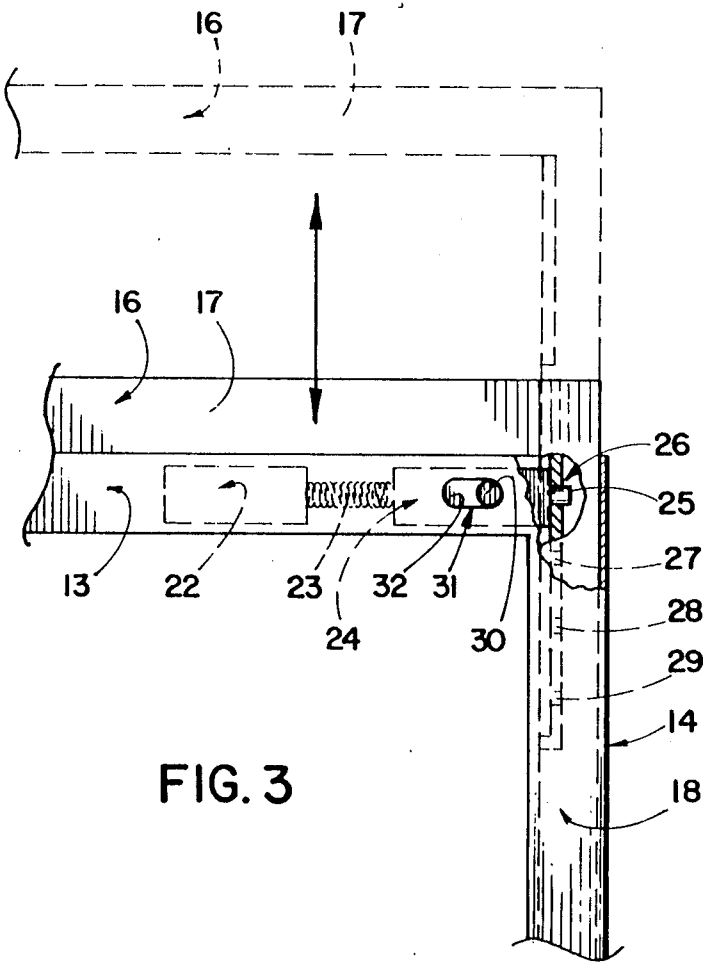
FIG. 3 illustrates a partial cross-sectional view of an arm, leg, frame and arm lock assembly.

The preferred form of the invention is illustrated in FIG. 2 whereby a stacking chair with a unitary synthetic molded seat and back has a tubular steel frame, legs, and arms. The collapsible arms are slidably positioned within the front legs of the chair and can be adjustably raised or lowered as necessary. Arm locking assemblies as shown in FIGS. 3 and 4 are mounted within the frame to securely hold the arms in any of a variety of positions and springs placed within the lower portions of the front legs "dampen" the final descent of the arms.

DETAILED DESCRIPTION OF THE DRAWINGS AND OPERATION OF THE INVENTION

Figure 1:
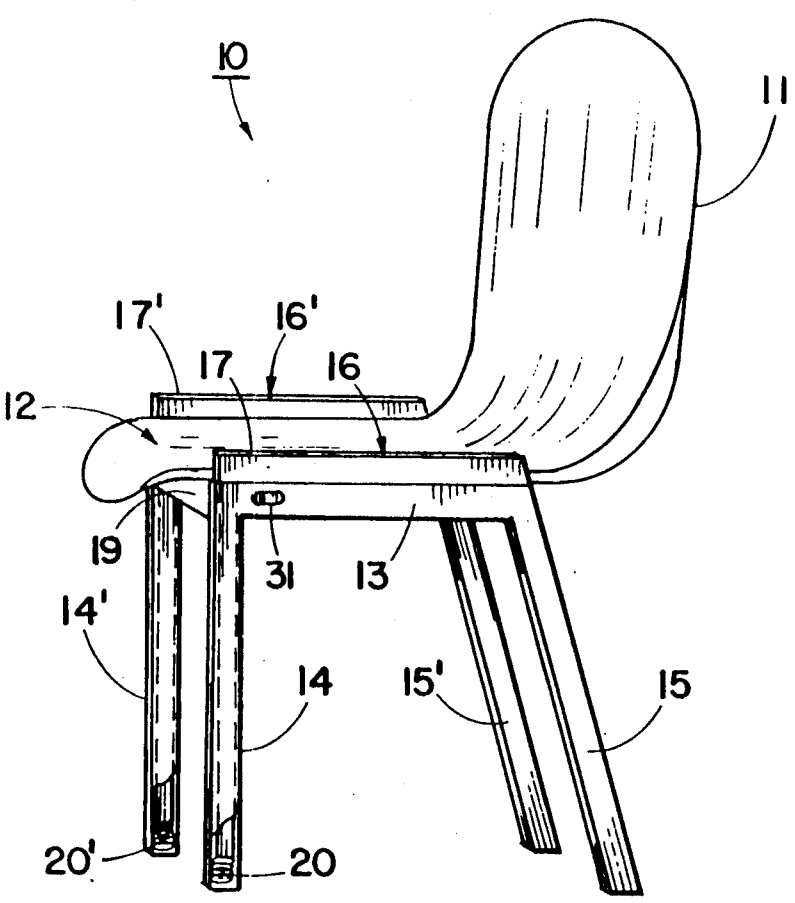
FIG. 1 exemplifies a stacking chair of the invention with the arms in a fully collapsed posture.

For a better understanding of the invention and its manner of operation, turning now to the drawings, stacking chair 10 as seen in FIG. 1 has a unitary molded back 11 and seat 12 which may be formed from one of a variety of synthetic polymer materials as available in the industry. Frame 13 is constructed of steel square tube stock and is welded to front legs 14, 14' and rear legs 15, 15'. Frame 13 includes a lateral member 19 which supports seat 12 as seen in FIG. 2. Chair arms 16, 16' are affixed to seat 12 via frame 13 as further explained hereinbelow. Arms 16, 16' consist of armrests 17, 17' which are substantially horizontal as illustrated in FIG. 2 and vertical armrest supports 18, 18' as also seen in FIG. 2. Armrests 17, 17' and armrest supports 18, 18' are formed from square tubular steel of somewhat less dimensions than legs 14, 14' for telescoping purposes.

As further shown in FIGS. 1 and 2, arms 16, 16' are slidably received as supports 18, 18' telescope from front legs 14, 14'. Arms 16, 16' could likewise be made to telescope in rear legs 15, 15' or both front and rear legs if desired. Within legs 14, 14', below armrest supports 18, 18' are resilient coil springs 20, 20' which will engage the terminal ends of supports 18, 18' as arms 16, 16' fully collapse. Coil springs 20, 20' dampen the descending velocity of arms 16, 16' and allow the user to safely collapse arms 16, 16' without being injured such as may occur if the user's palms or fingers were caught between armrest 17 and frame 13 as shown in FIG. 1. Springs 20, 20' require the user to urge arms 16, 16' into a locked storage posture, as opposed to merely releasing said arms and allowing gravity to cause their full descent. Springs 20, 20' are also helpful in initially raising arms 16, 16' a short distance from frame 13 to allow the user an easier grasp.

It is important that arms 16, 16' be locked at selected heights and be locked when fully collapsed. Accordingly, arm lock assembly 21 as shown in FIG. 4 removed from frame 13 includes anchor 22 which is firmly affixed within hollow frame 13 and attached to a first coil spring or resilient member 23. Slide member 24 likewise is joined to resilient member 23 as seen in FIG. 3. Slide member 24 moves within frame 13 to engage armrest support 18 with lock pin 25. As further shown in FIG. 3, lock pin 25 is within opening 26 of armrest support 18 while armrest 17 is fully depressed and rests against frame 13. As additionally seen in FIG. 3 in ghost fashion, armrest 17 is slightly raised above frame 13.

A plurality of openings 26, 27, 28 and 29 are defined by armrest support 18 for receiving lock pin 25. As would be understood, a comparable locking assembly (not shown) is provided on the opposite side of seat 12 for arm 16'. In order to remove pin 25 from armrest support 18 such as when it is desirable to raise or lower arm 16, grip 30 is manipulated. By placing the index finger on grip 30, it can be readily slid rearwardly along slot 31 as shown in FIGS. 2 and 3 while compressing spring 23. Once lock pin 25 has disengaged from one of the lock pin openings of armrest support 18, arm 16 can be manually raised or lowered as required. Upon release of grip 30, resilient member 23 forces lock pin 25 forwardly whereupon it will engage an available opening of armrest support 18, locking arm 16 in place.

Figure 5:
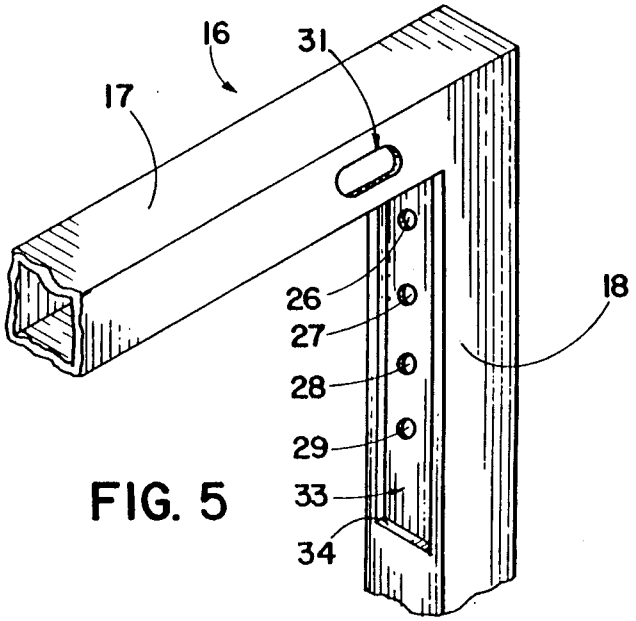
FIG. 5 shows the arm removed from the frame to better demonstrate the lock pin groove and lock pin openings.

In FIG. 5, armrest support 18 is shown in fragmented fashion, removed from chair 10 and as further pictured, includes a lock pin groove 33 communicating with pin openings 26, 27, 28 and 29. Groove 33 includes a terminal stop ledge 34 which prevents accidental withdrawal of arm 16 from leg 14 of chair 10 as may occur if arm 16 were too rapidly raised. Stop 34 will contact lock pin 25 to prevent total withdrawal of armrest support 18 from leg 14, although pin 25 has been removed from the several lock pin openings within armrest support 18. As shown in FIG. 3, grip 30 is used to manually control the rearward movement of slide member 24 but does not allow pin 25 to be withdrawn totally from leg 14 since grip 30 contacts rear wall 32 of frame slot 31 as seen in FIG. 3 during rearward movement.

The illustrations and examples provided herein are for explanatory purposes and are not intended to limit the scope of the appended claims.

We claim:

1. In a stacking chair having a one piece molded seat and back with a tubular seat frame and legs, the improvement comprising: a collapsible arm, said arm defining a lock pin groove, said groove defining a plurality of lock pin openings for receiving a lock pin, said arm telescopically positioned within one of said legs for movement in the vertical direction therein, an arm locking assembly, said locking assembly comprising a slide member, a lock pin, said lock pin joined to said slide member, said locking assembly resiliently mounted within said seat frame for slidably engaging said collapsible arm to lock said arm at a desired height, a spring member, said spring member contained within said leg below said arm for contact therewith to dampen the downward movement thereof when said arm is lowered and for release therefrom when said arm is raised whereby collapsing said arm will allow said chair to be compactly stacked upon similar, said groove further defining a stop ledge for engagement with said lock pin to prevent removal of said arm from said tubular frame when said lock pin is withdrawn from one of said lock pin openings whereby said stop ledge extends perpendicular from the vertical direction of movement of said arm.

2. The chair as claimed in claim 1 wherein said slide member comprises a finger grip, and said tubular frame defining a slot, said slot for receiving said finger grip whereby said slide member can be manually manipulated by said finger grip as said finger grip extends through said slot.

3. The chair as claimed in claim 1 comprising a pair of collapsible arms.

4. In a stacking chair having a one piece molded seat and back with a tubular seat frame and legs, the improvement comprising: a collapsible arm, said arm telescopically positioned within one of said legs for movement in the vertical direction therein, an arm locking assembly, said locking assembly comprising a slide member, a cylindrical lock pin, said lock pin joined to said slide member, a cylindrical finger grip, said finger grip joined to said slide member, an anchor member, said anchor member affixed within said tubular seat frame, said slide member resiliently joined to said anchor member, said lock pin for slidable withdrawal from and engagement with said collapsible arm to lock said arm at a desired height, said tubular seat frame defining a slot, for receiving said finger grip for manual manipulation of said slide member positioned therein, a spring member, said spring member contained within said leg below said arm for contact therewith to dampen the downward movement thereof when said arm is lowered and for release therefrom when said arm is raised, said arm defining a lock pin groove and a plurality of lock pin openings therein, said groove comprising a stop ledge extending perpendicular from the vertical direction of movement of said arm, said stop ledge for engagement with said lock pin when said lock pin is withdrawn from one of said lock pin openings to prevent removal of said arm from said tubular seat frame as said lock pin engages said stop ledge and whereupon collapsing said arm will allow said chair to be compactly stacked upon a similar chair.

* * * * *